US006422324B1

(12) United States Patent
Tibussek et al.

(10) Patent No.: US 6,422,324 B1
(45) Date of Patent: Jul. 23, 2002

(54) METHOD AND DEVICE FOR DRIVING BORE-HOLES, IN THE SEA BED USING A COUNTERFLUSH METHOD

(75) Inventors: Fritz Tibussek, Monchengladbach; Hermann-Josef Von Wirth, Titz, both of (DE)

(73) Assignee: Wirth Maschinen-und Bohrgeratefabrik GmbH, Erkelenz (DE)

( * ) Notice: Subject to any disclaimer, the term of this patent is extended or adjusted under 35 U.S.C. 154(b) by 0 days.

(21) Appl. No.: 09/319,657

(22) PCT Filed: Nov. 27, 1997

(86) PCT No.: PCT/DE97/02770

§ 371 (c)(1),
(2), (4) Date: Aug. 6, 1999

(87) PCT Pub. No.: WO98/26151

PCT Pub. Date: Jun. 18, 1998

(30) Foreign Application Priority Data

Dec. 10, 1996 (DE) ..... 196 51 303
Jan. 28, 1997 (DE) ..... 197 02 984

(51) Int. Cl.[7] ..... E21B 7/12; E21B 17/07
(52) U.S. Cl. ..... 175/5; 175/321; 166/355
(58) Field of Search ..... 166/350, 355; 285/302, 145.1; 175/321, 213, 215, 5, 6, 7, 10

(56) References Cited

U.S. PATENT DOCUMENTS

| | | | | |
|---|---|---|---|---|
| 3,259,198 A | | 7/1966 | Montgomery et al. | 175/7 |
| 3,319,726 A | | 5/1967 | Brown | 175/5 |
| 3,387,672 A | | 6/1968 | Cook | 175/69 |
| 3,603,409 A | | 9/1971 | Watkins | 175/7 |
| 3,631,932 A | * | 1/1972 | Lindelof | 175/6 |
| 3,633,685 A | | 1/1972 | Piexoto | 175/6 |
| 3,664,443 A | | 5/1972 | Campbell | 175/293 |
| 3,726,546 A | | 4/1973 | Brown | 285/91 |
| 3,763,580 A | * | 10/1973 | Kuntz, Jr. | 175/5 X |
| 3,764,168 A | * | 10/1973 | Kisling, III et al. | 285/302 |
| 3,823,788 A | | 7/1974 | Garrison et al. | 175/94 |
| 3,889,764 A | | 6/1975 | Jackson | 175/69 |
| 3,919,958 A | | 11/1975 | Graham et al. | 114/5 D |
| 3,940,982 A | * | 3/1976 | Hironaka | 173/170.32 |
| 4,055,224 A | | 10/1977 | Wallers | 175/5 |
| 4,136,633 A | * | 1/1979 | Homer et al. | 175/5 X |
| 4,234,047 A | * | 11/1980 | Mott | 175/5 |
| 4,448,269 A | | 5/1984 | Ishikawa et al. | 175/335 |
| 4,901,803 A | * | 2/1990 | Levier | 175/5 |
| 5,035,291 A | | 7/1991 | Shields | 175/5 |
| 5,139,094 A | * | 8/1992 | Prevedel et al. | 175/61 |

FOREIGN PATENT DOCUMENTS

| | | |
|---|---|---|
| FR | 2 523 205 | 9/1988 |
| GB | 2 163 465 | 2/1986 |
| GB | 2 231 601 | 11/1990 |

* cited by examiner

*Primary Examiner*—David Bagnell
*Assistant Examiner*—Sunil Singh
(74) *Attorney, Agent, or Firm*—Foley & Lardner

(57) ABSTRACT

Method of, and apparatus for, sinking bore holes, in particular exploratory and extraction bore holes, in the sea bed (40). The material from the sea bed is loosened with the aid of a rotating drill head (10) which is arranged at the bottom end of a drill string (5) which is suitable for transmitting a torque. The top end of the drill string is mounted on a floating platform (1), it being the case that the drill string (5) comprises at least two telescopically interengaging drill-string parts (6, 7) which, during a vertical movement of the platform, induced for example by the sea swell, execute a movement relative to one another, with the result that the drill head (10) rests with an essentially constant force on the surface which is to be cleared away.

22 Claims, 5 Drawing Sheets

METHOD AND DEVICE FOR DRIVING BORE-HOLES, IN THE SEA BED USING A COUNTERFLUSH METHOD

BACKGROUND OF THE INVENTION

The invention relates to a method of, and an apparatus for, sinking bore holes, in particular exploratory and extraction bore holes.

Exploratory bore holes are intended for the purpose of examining deposits and to make it possible to take samples of the material present in the deposit. Exploratory bore holes are sunk, in particular, when the deposit is at a considerable depth and/or bodies of water lying above the deposit, such as seas or oceans, preclude the possibility of sinking exploratory shafts.

Extraction bore holes serve the purpose of loosening deposit contents from soil strata. An example for extraction bore holes which may be mentioned is the extraction of marine sediments with diamond inclusions deposited on the sea bed. Such diamond-containing deposits have usually formed upstream of estuaries in the form of reasonably sized layers spread out over a rocky base. For extracting the diamond-containing sediment material, use is usually made of apparatuses which comprise a drill head which is lowered to the sea bed with the aid of an extensible drill-pipe string extending from a floating platform. Floating platform is to be understood as any arrangement of which the height above the sea bottom or ocean floor depends on the water level at any one time. Drilling vessels are particularly suitable here.

In order to make the drill head rotate, this rotational movement being required for the drilling operation, either said drill head is arranged in a rotationally fixed manner on the drill-pipe string and the latter is made to rotate with the aid of a rotary drive (powered rotary head) arranged above the platform, or the drill string is mounted in a rotationally fixed manner on the platform and there is provided a drive which makes the drill head rotate with respect to the drill string.

The overburden which is loosened during the drilling operation is usually delivered up to the platform, through the interior of the drill string, by so-called "reverse circulation" —for example by using the known air-lift method—and at the platform is fed, via a pipe bend which is provided at the top end of the drill string and is in connection with the inner volume thereof, to arrangements in which diamonds and overburden are separated in a known manner.

Since the prerequisite for a satisfactory drilling result is that the drill-head end side which is equipped with at least one cutting tool always butts throughout the drilling operation, with an approximately constant advancement pressure against the end side of the bore hole, the platform comprises an arrangement which allows a vertical movement of the platform, called for example by sea swell, without this resulting in the advancement force fluctuating to any great extent or in the drill head being lifted off from the sea bed at all. Such arrangements comprise pneumatic or hydraulic/pneumatic piston/cylinder arrangements which are usually connected to a relatively large equalizing volume and are connected, for example, on the cylinder side to the drill string and, on the piston side, to an arrangement which bears the drill string, for example a drilling derrick. The equalizing volume connected to the cylinders means that the platform can execute vertical movements without the force with which the drilling tool butts against the sea bed changing to any considerable extent. If the fastening point of the piston/cylinder arrangement on the platform side is located beneath those on the drill string, then it is possible, by adjusting the pressure in the equalizing reservoirs, for the contact pressure of the drill head on the sea bed to be adjusted to a desired value from a maximum of the resultant weight.

Although such arrangements for equalizing vertical movements of the platform have frequently been used for some time now, it is disadvantageous that the drill string has to project out of the top side of the platform at least by half the maximum expected displacement of the vertical movement of the platform—in relation to the central position thereof—and it is also only at this height that it is possible to fit the pipe bend which is necessary for discharging the overburden to the separating arrangement. This is disadvantageous because, on the one hand, the center of gravity of the platform is displaced upward to a considerable extent, as a result of which the period in which the weather is favorable enough for use of the platform is reduced, and, on the other hand, the overburden has to be delivered up to the level of the pipe bend. This is associated with high energy outlay, in particular, when the platform is located at its lowest level, for example in a wave trough, since the energy outlay depends on the height of the pipe bend above the water surface.

U.S. Pat. No. 3,319,726 discloses an apparatus which is intended for sinking bore holes in the sea bed and in the case of which, in order to equalize the vertical movement of the platform, the drill string comprises two telescopically interengaging drill-string parts which can be displaced axially relative to one another. Serving for mounting the inner and outer drill-string parts is a high-outlay arrangement which comprises a plurality of seals and floating pistons for pressure equalization, is filled with a hydraulic fluid and is fully encapsulated toward the outside against the penetration of sediment. The disadvantage with this apparatus is that it involves high outlay to produce.

Furthermore, U.S. Pat. No. 3,259,198 and U.S. Pat. No. 3,669,993 disclose apparatuses in the case of which the drill string comprises a telescopic part which is intended to equalize, inter alia, the movement induced by the sea swell. In the case of these apparatuses, the drilled maternal is delivered upward via the interior of the drill string by fresh water being fed to the bore hole under pressure. For this purpose, the drill string contains two concentrically arranged tubes which form an annular gap between them. The fresh water is fed by way of the annular gap, and the drilled material is transported away by way of the inner tube. The drill strings of these apparatuses too involve higher outlay to produce.

SUMMARY OF THE INVENTION

The object of the invention is thus further to develop a method and an apparatus of the abovementioned type so as to improve on these disadvantages.

This object is achieved by an embodiment of the method and by an embodiment of the apparatus set out below.

Since, in the case of the method according to the invention, the drill string comprises at least two telescopically interengaging drill-string parts which, during a vertical movement of the platform, induced for example by the sea swell, execute a movement relative to one another, it is no longer necessary for the drill string to project beyond the platform by at least half the maximum expected vertical deflection of the platform; rather, it is possible for the top end of the drill string to be located directly above the platform surface. As a result, on the one hand, this considerably reduces the height of the center of gravity of the platform, with the result that, in relation to those platforms in the case of which the vertical movement is equalized above the platform, it is also possible to use this platform in rough seas, and, on the other hand, the now likewise lower pipe bend considerably reduces the delivery height which is necessary for lifting the overburden, with the result that, with the energy requirement remaining the same, the delivery quantity can be increased or else, with the delivery quantity remaining the same, the energy requirement can be lowered. The negative pressure which prevails in the interior of the drill string when use is made of a reverse circulation method, preferably the air-lift method, which is know per se from FR 2523205 for example, means that a certain quantity of surrounding water is always sucked in through the annular gap which is inevitably located between the telescopically interengaging drill-string parts, so that there is always water circulating around this region, as a result of which any sediment parts which may have penetrated are always washed out. It is thus possible to dispense with seals and specially protected mounting arrangements.

In the case of one possible embodiment of the method according to the invention, the drill head is arranged in a rotationally fixed manner on the drill string. In order to produce the rotation of the drill head, there is provided on the platform a drive which makes the drill string rotate.

In the case of one of the preferred embodiments of the method, however, the drill string is mounted in a rotationally fixed manner on the platform and the drill head is made to rotate relative to the drill string. By virtue of this configuration, on the one hand, the drive which increases the weight of the platform and possibly displaces its center of gravity upward is rendered superfluous and, on the other hand, it is possible for the drill string to serve for routing electric, hydraulic or similar lines without high-outlay rotary lead-throughs or couplings being required for this purpose. It is then also easily possible for one end of a cable which is routed to the platform to be fitted on the bottom drill-string part, as a result of which it is possible, without high energy outlay, for the bottom drill-string part, together with the drill head, to be lifted, for example, from the bottom of the bore hole and displaced over the sea bed to the location at which a further bore hole is to be sunk.

The apparatus-related aspect of the invention is one preferred embodiment.

In the case of on of the preferred embodiments, the drill string comprises an outer and an inner drill-string part, it being the case that—in order that the vertical movement of the platform can be equalized—the inner drill-string part is pushed into the outer drill-string part in the normal position of the platform, at least over a length which corresponds to the maximum upward vertical movements of the platform which are to be expected as a result of sea swell or the like, and can be displaced further into the outer drill-string part, at least by an amount which corresponds to the maximum expected downward deflection of the platform out of its normal position.

Since the inner and outer drill-string parts have to be connected to one another in a rotationally fixed manner, in order to be able to transmit the drive torque or the reaction torque, a configuration of the drill string including rails and sliding elements is recommended. This ensures that, despite the fact that they are fixed rotationally, a low-friction movement of the two drill-string parts relative to one another is possible.

A particularly preferred technical configuration of the mounting which works on this principle forms the subject matter of other preferred embodiments as set out below.

It is possible, on the one hand, for the outer drill-string part to be arranged on the platform by way of its top end and for the drill head to be arranged at the bottom end of the inner drill-string part. In the case of one of the preferred embodiments, however, the arrangement is the other way round, since the top, preferably longer top drill-string part, which during the drilling operation, in a vertical direction, is connected rigidly to the platform, comprises components which involve less outlay to produce.

In the case of a first possible embodiment of the apparatus according to the invention, there is provided on the platform an arrangement with which the drill string can be provided to rotate about its longitudinal axis. In this case, the drill head is arranged in a rotationally fixed manner on the drill string.

In the case of one of the preferred embodiments. however, the drill string is mounted in a rotationally fixed manner on the platform and there is provided a rotary drive, with the aid of which the drill head can be made to rotate with respect to the drill string.

In the case of the above mentioned preferred embodiment the rotationally fixed mounting of the drill string on the platform preferably takes place by means of a rotationally fixed, cardanic retaining means (gimbal).

The drill head is preferably driven either electrically or hydraulically, it being the case that the drive arrangements are preferably integrated in the drill head or are arranged directly above the same.

The pressure line which is required for using the air-lift method may, according to an alternative embodiment, be secured on the outer circumference of the drill string and run parallel to the longitudinal center axis thereof.

In the case of an advantageous embodiment, however, the pressure line is designed as a pressure hose which can be unrolled from a winding drum. This measure has the advantage that the pressure hose can easily be connected both to the top drill-string part and to the bottom drill-string part.

An advantageous development of the apparatus according to the invention forms the subject matter of an alternative embodiment. In this case, at least one buoyancy element is arranged on the drill-string part which bears the drill head. In the case of the apparatus according to the invention, selection of the buoyancy volume of the buoyancy element makes it possible to adjust the desired contact pressure of the drill head on the sea bed.

In order to avoid the situation where the bottom drill-string part is subjected to compressive loading by too high a buoyancy volume of the buoyancy element, it is advantageous, according to an alternative embodiment, for the at least one buoyancy element to be arranged in the vicinity of the top end of the bottom drill-string part.

Straightforward adjustment of the contact pressure, this adjustment also being possible once the drill head has been lowered onto the sea bed, is provided if the buoyancy elements are designed as floodable tanks which can be filled with compressed air as desired, via corresponding compressed-air lines, possibly by a compressor located on the platform.

If, according to an alternative embodiment, a buoyancy element is also provided on the drill-string part which is mounted on the platform, it is possible to compensate for some of the weight acting on the platform, with the result that heavier, and thus longer, drill-string parts can be secured and the apparatus is also suitable for sinking exploratory bore holes at considerable depth.

BRIEF DESCRIPTION OF THE DRAWINGS

The method according to the invention and an exemplary embodiment of an apparatus according to the invention are illustrated in the drawings, in which.

DETAILED DESCRIPTION OF PREFERRED EMBODIMENTS

Figure 1:
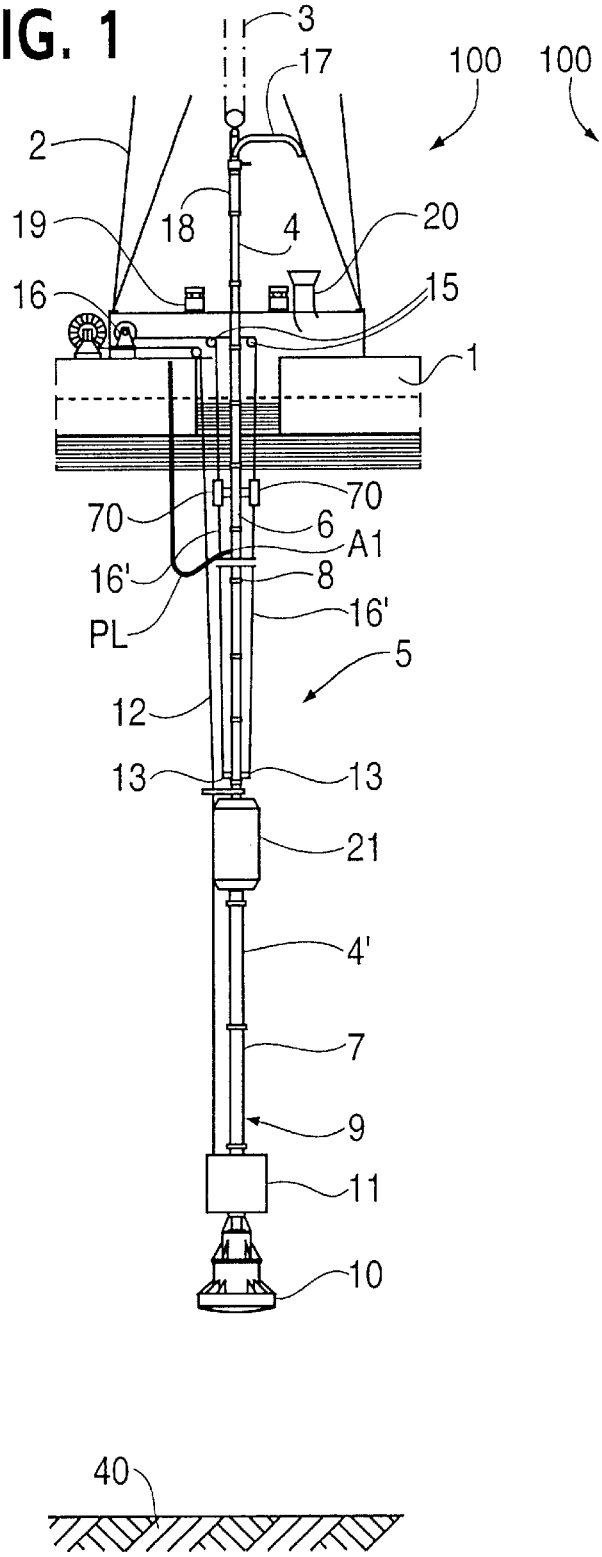
FIG. 1 shows a side view of an embodiment of the apparatus according to the invention in the case of which the drill string has already been assembled to its full length, but has not yet been lowered into its operating position.
Figure 2:
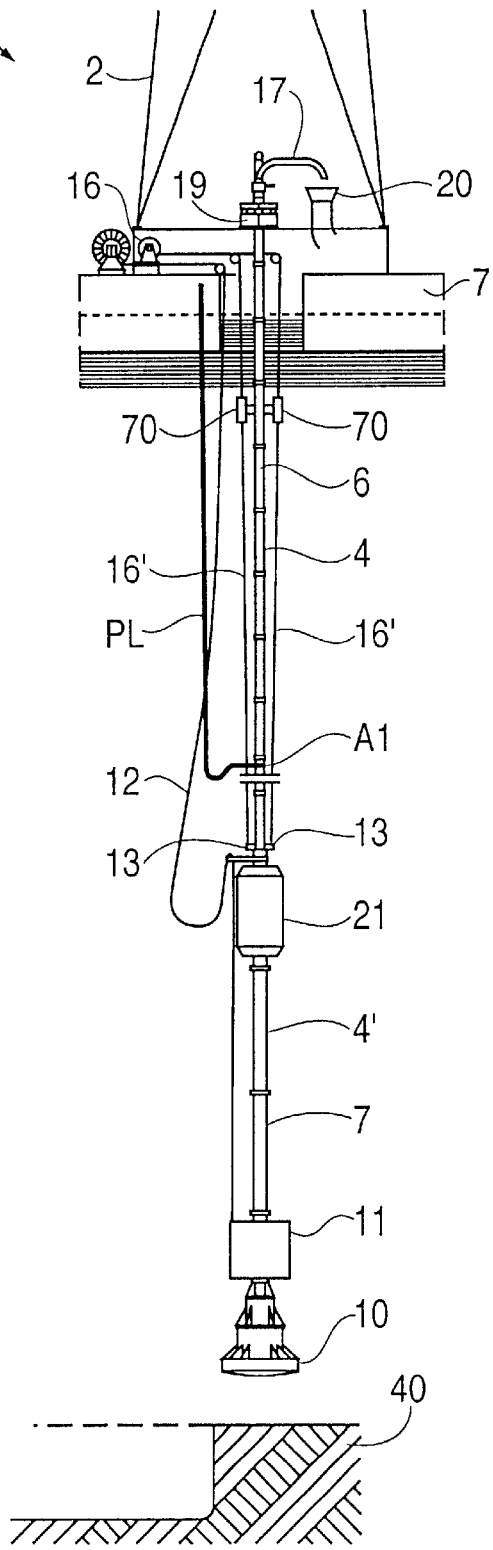
FIG. 2 shows the same embodiment with a drill string which is located in its operating position on the platform but has the drill head lifted off from the sea bed.
Figure 3:
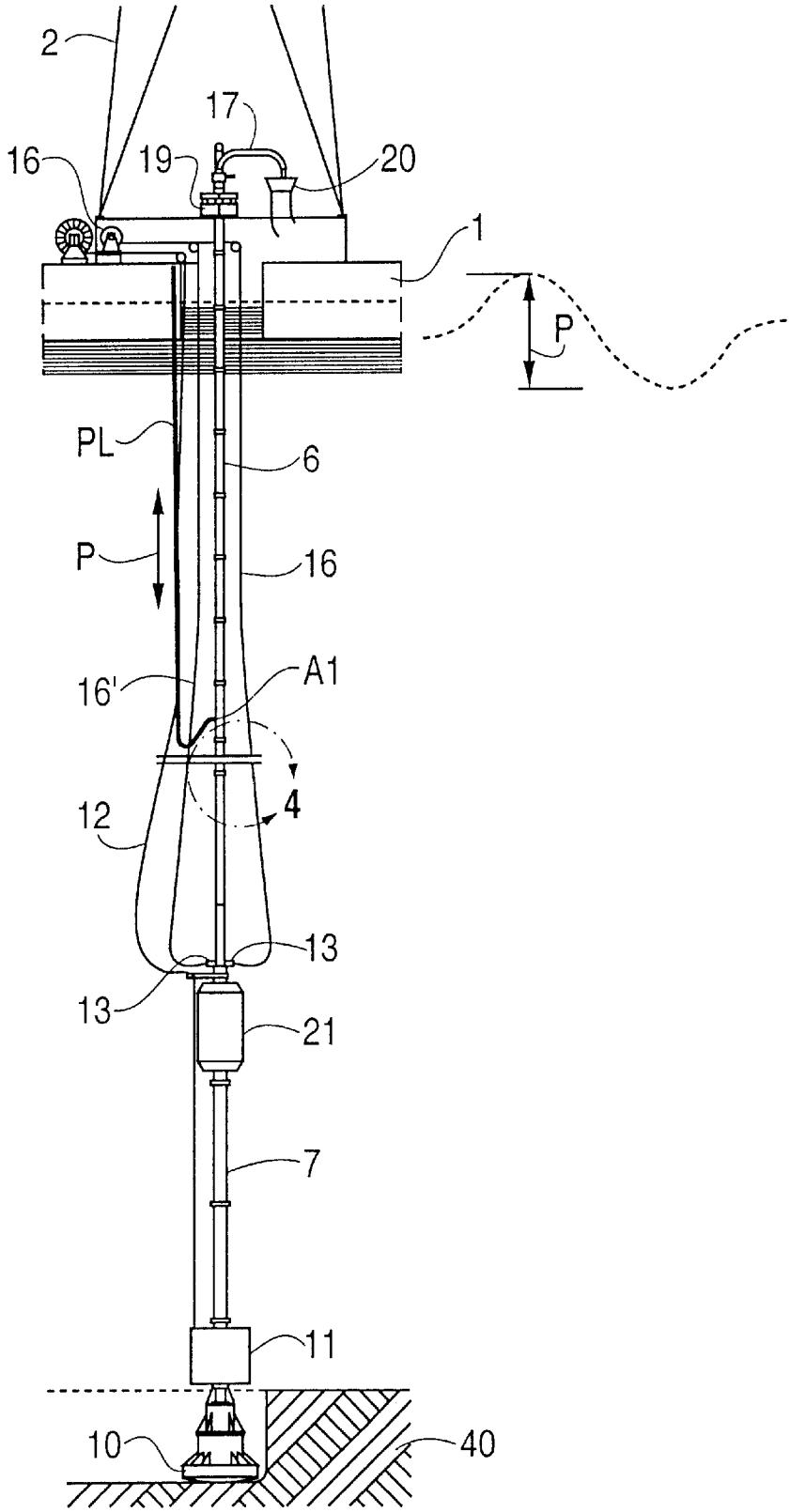
FIG. 3 shows the same embodiment at the end of a drilling operation.

The apparatus, which is designated as a whole by 100 in FIGS. 1 to 3, comprises a mast 2 which is arranged on a floating platform 1 and is only indicated in FIGS. 1 to 3. As is likewise merely indicated in FIG. 1, it is equipped with a block and tackle 3 which serves for lifting or lowering one or more segments 4, 4' of a drill string, which is designated as a whole by 5.

Serving for providing and transferring the drill-string segments 4, 4' to the block and tackle 3 are means which are known for this purpose and are usually referred to as pipe erector or pipe handling system, but are not illustrated in the drawing.

The drill string 5, which—as has already been explained in the introduction—comprises removable segments 4, 4', has a top drill-string part 6 and a bottom drill-string part 7. The top drill-string part 6 opens out telescopically into the bottom drill-string part 7 at the location 8 and, according to the illustration in FIG. 1, projects into said bottom drill-string part approximately as far as location 9. The top and the bottom drill-string parts 6, 7 are configured in that length region which is provided for the insertion of the top drill-string part, such that, in this length region, the drill-string parts 6, 7 can move with low friction relative to one another in the longitudinal direction of the drill string, although rotation of the two drill-string parts 6, 7 with respect to one another about the longitudinal center axis of the drill string is not possible. A type of mounting which exhibits these functional features is described in more detail hereinbelow with reference to FIGS. 4 and 5.

Arranged at the bottom end of the bottom drill-string part is a drill head 10 which, with the aid of a rotary drive 11 arranged above it on the bottom drill-string part, can be rotated relative to the drill string 5, which in the exemplary embodiment is mounted in a rotationally fixed manner in the platform and absorbs the reaction torque. In the exemplary embodiment illustrated, the power source used is a hydraulic motor which is supplied with hydraulic fluid under pressure via a hydraulic line 12. However, it is likewise possible to use an electric drive instead of the hydraulic drive and to provide an electric line instead of the hydraulic line 12.

Figure 7:
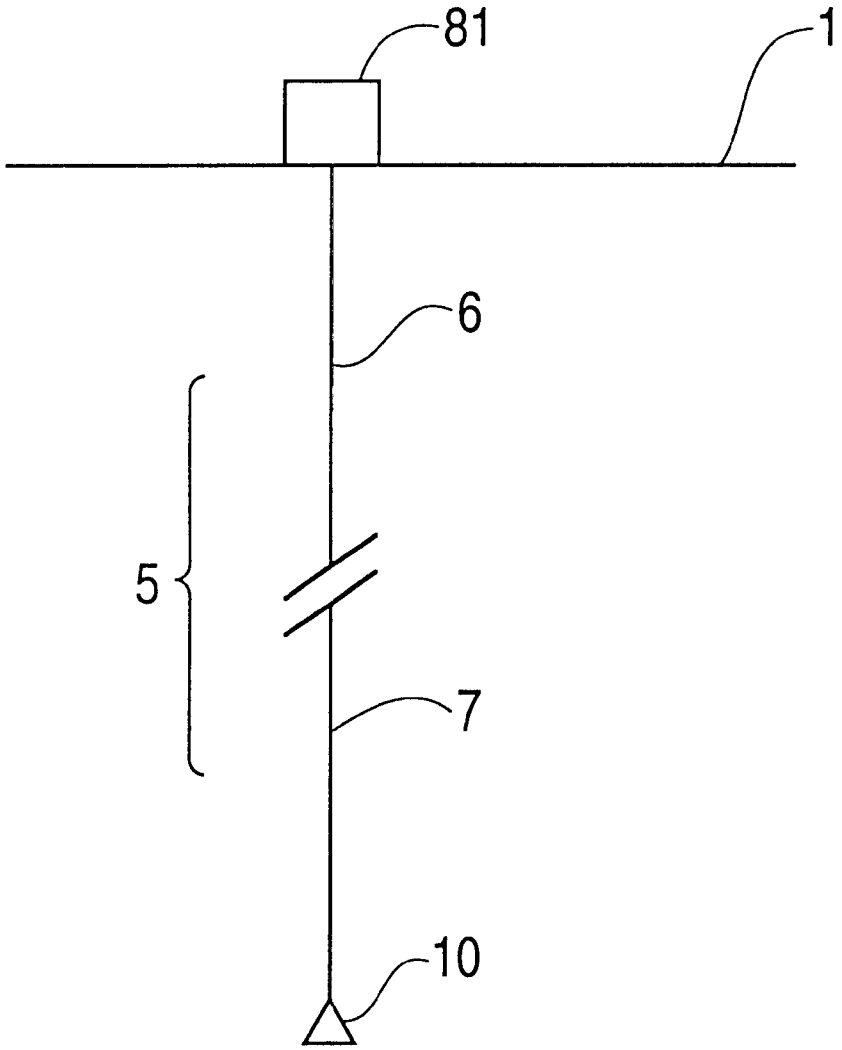
FIG. 7 shows a schematic view of an alternative embodiment of the invention in which a powered rotary head is arranged on the platform for rotating the drill string, and the drill head is arranged in a rotationally fixed manner on the drill string.

An alternative embodiment, as shown schematically in FIG. 7, is characterized in that arranged on the platform (1) is a powered rotary head (81) for making the drill string (5) rotate about its longitudinal axis, and the drill head (10) is arranged in a rotationally fixed manner on the drill string.

Provided at the top end of the bottom drill-string part are two eye elements 13 on which there are fastened two cables 16' which run through an opening 14, provided in the platform and through which the drill string 5 also extends, and are fed to a winch 16 via deflection rollers 15. The bottom drill-string part can thus be lifted and lowered by virtue of the winch 16 being actuated.

First of all the basic functioning of the apparatus according to the invention is to be described hereinbelow with reference to FIGS. 1 to 3.

In the phase which is illustrated in FIG. 1, the drill string 5 has already been assembled to its full length by the screw-connection of individual segments 4 and 4'. Arranged at the top end of the drill string is the pipe bend serving for the discharge of lifted overburden. By virtue of the block and tackle 3 and the winch 16 being paid out synchronously, the drill-string parts 6, 7 are lowered until the top region 18 of the top drill-string part 6 is located level with a cardanically mounted retaining means 19 (gimbal), which is illustrated schematically in the open state in FIG. 1.

The top drill-string part is fixed in this position by virtue of the retaining means 19 being closed. This state is illustrated in FIG. 2. The pipe bend 17 then opens out into an inlet 20 which is widened in the form of a funnel at its end and feeds the overburden to a known arrangement (not illustrated in the drawing) for separating off diamonds contained in the overburden.

In the state which is illustrated in FIG. 2, the apparatus 100 is positioned such that the drill head is located above that part of the sea bed which is to be cleared away.

Before the actual drilling operation begins, the winch 16 is paid out, as a result of which the bottom drill-string part 7 is lowered further, by sliding down on that part of the top drill-string part 6 which projects into it, until the drill head 10 rests on the sea bed. The cables 16' are then paid out further, with the result that—as is illustrated in FIG. 3—they hang down in a slack loop. The resultant weight of the bottom drill-string part 7 and of the components connected thereto determines the contact pressure between the end side of the drill head and the sea bed. During further advancement of the drill head 10 into the sea bed 40, the bottom drill-string part 7 can slide down further without obstruction from the top drill-string part 6.

If the platform—induced for example by the sea swell—executes a vertical movement, as is in tended to be symbolized by the double arrow in FIG. 3, it being possible for this vertical movement to measure quite a few meters, depending on the weather conditions then the contact pressure of the drill head 10 on the sea bed 40 is not affected as a result since the inner drill-string part 6 can be displaced with low friction in and out of the bottom drill-string part 7 corresponding to the vertical movement of the platform.

In order for it to be possible to adjust the end-side contact pressure of the drill head 10 on the sea bed 40, a buoyancy unit 21 is arranged in the region of the top end of the bottom drill-string part. This buoyancy unit comprises a plurality of tanks (not shown in the drawing) which may optionally be flooded or, with the aid of over compressed-air lines (not illustrated in the drawing) emptied, with the result that the buoyancy can be adjusted and the resultant contact pressure between the drill head and the sea bed can thus be reduced to the value required in each individual case.

Figure 5:
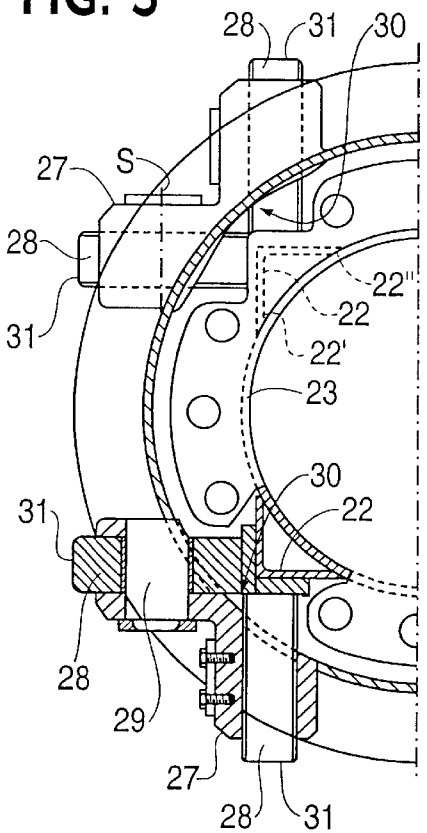
FIG. 5 shows a cross section along section line V—V in FIG. 4.
Figure 4:
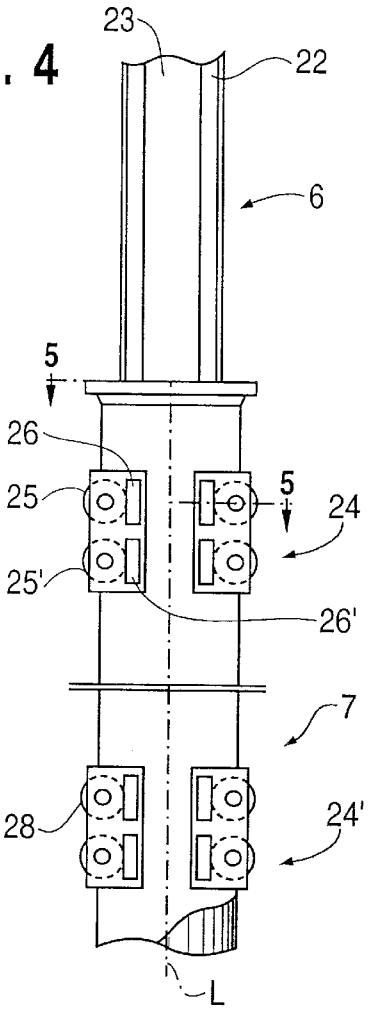
FIG. 4 shows an enlarged illustration of the detail IV in FIG. 3.

A preferred technical configuration of the mounting between the top and the bottom drill-string parts 6, 7 is to be explained hereinbelow with reference to FIGS. 4 and 5.

The top drill-string part, which is of essentially tubular configuration, comprises a tubular part 23 which has a round cross section and is subdivided into segments 4 which can be screw-connected to one another by means of flanges. Over its length which can be introduced into the bottom drill-string part, four angle profiles 22, which are distributed uniformly over the circumference, are arranged on the tubular part 23 parallel to the longitudinal center axis L. Each angle profile 22 comprises two legs 22', 22" which are at right angles with respect to one another. The angle profiles 22 are welded over their length—in any case in certain sections thereof—to the tubular part 23 of the top drill-string part 6 by way of the free edges of the legs 22', 22".

Serving for mounting the top drill-string part 6 in the bottom drill-string part 7, said mounting allowing the top and bottom drill-string parts to move relative to one another in the axial direction and being suitable for transmitting torques directed about the longitudinal center axis L, are roller arrangements 24 which are arranged on the bottom drill-string part 7, are distributed over the circumference, corresponding to the angle profile 22, and are in operative connection with the angle profiles. Each roller arrangement 24 comprises two pairs of rollers 25, 26, it being the case that the rollers 25, 25'; 26, 26' belonging to a pair are spaced apart from one another in the direction of the longitudinal center axis and have their axes of rotation running parallel to one another, whereas the axes of rotation of the roller pairs 25, 26 of a roller arrangement 24 are aligned perpendicularly to one another. In the case of the exemplary embodiment which is illustrated in FIG. 4, two sets of in each case four roller arrangements 24, 24' are provided in the longitudinal direction of the drill string in order for it to be possible to prevent canting of the top drill-string part in the bottom drill-string part. However, it is likewise possible to provide a greater number of roller pairs.

Each roller arrangement 24 comprises a roller holder 27 which is arranged on the outer lateral surface of an essentially tubular segment 4' of the bottom drill-string part 7. Bores for receiving roller shafts 29 are made in the roller holder 27 corresponding to the alignment and number of rollers 28 belonging to a roller arrangement 24. In this case, the bores are arranged such that the axes of rotation S are located essentially outside the cross section of the bottom drill-string part 7, but the rollers 28 project, through openings 30, into the inner cross section of the segment 4', with the result that the running surfaces 31 of the rollers are aligned in a manner corresponding to the outer surfaces of the angle profiles 22 and, when the drill-string parts 6, 7 have been pushed one inside the other, roll on the outer surfaces of the angle profiles.

This type of mounting ensures low-friction displaceability of the top and of the bottom drill-string parts in the longitudinal direction relative to one another, while at the same time it is possible to transmit high reaction torques about the longitudinal center axis L.

The overburden is delivered from the bottom of the bore hole to the platform by the known air-lift method (not illustrated in the drawing), in the case of which air is blown into the interior of the drill string via a corresponding feed line or pressure line PL, and air inlet Al.

Figure 6:
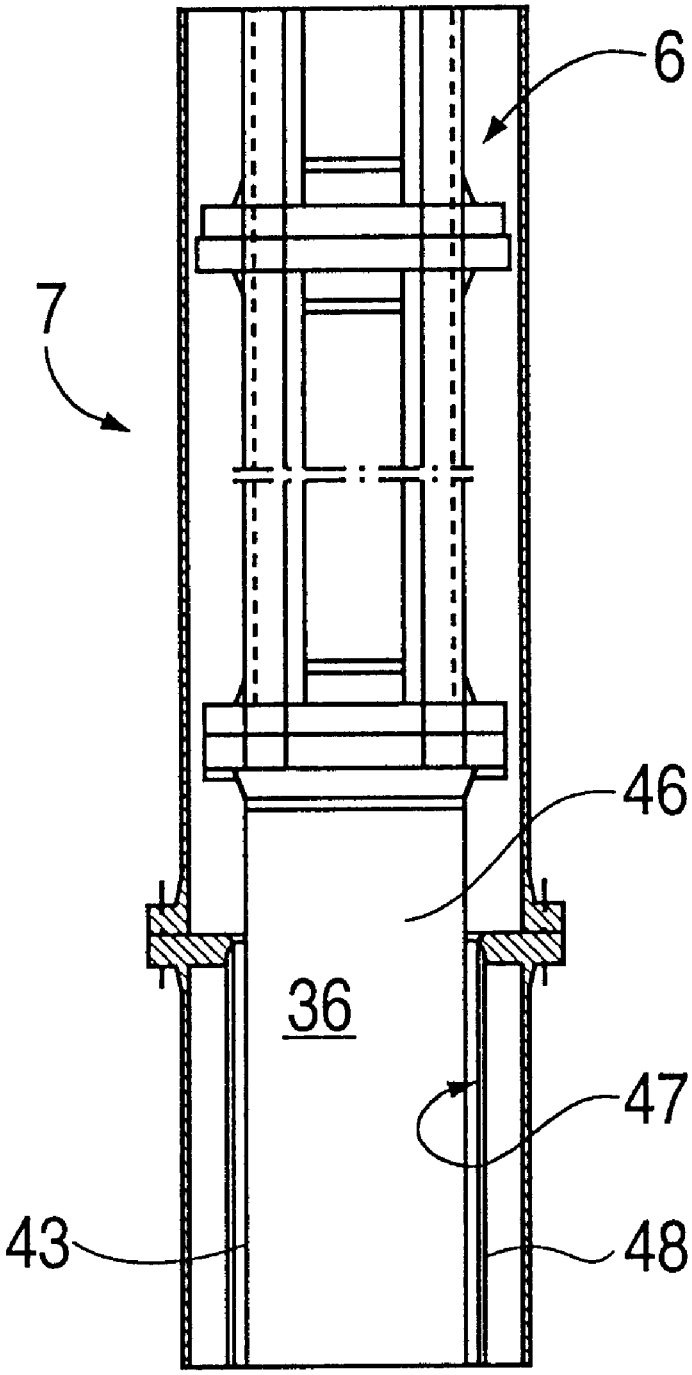
FIG. 6 shows an illustration, in longitudinal section and in detail form, of the drill string in the region in which the inner drill-string part projects into the outer drill-string part.

In order to prevent the sediment which passes into the drill string from penetrating into the mounting between the top and bottom drill-string parts 6, 7 and obstructing the capacity of the parts for low-friction movement relative to one another, an inner tube 36 ("rapier tube") is flanged—as can be seen from FIG. 6—at the bottom end of the top drill-string part, which projects into the bottom drill-string part 7, said inner tube projecting into that part of the bottom drill-string part 7 which is located beneath it and terminating in an open state just above the rotary drive 11. The bottom drill-string part 7 is of double-walled design in this region, the inner wall 47 being formed by an inner tube 48, of which the internal diameter is dimensioned such that a narrow annular gap 49 is formed between said internal diameter and the external diameter of the inner tube 46.

By virtue of this measure, the loosened sediment penetrates into the interior of the top drill-string part through the bottom opening of the inner tube 36, as a result of the negative pressure which prevails in the inner volume of the top drill-string part by virtue of the air-lift method being used, with the result that even at this stage said sediment cannot come into contact with the roller arrangements 24 or angle profiles 22. Furthermore, the negative pressure which prevails in the interior of the top drill-string part 6 means that there is always a certain quantity of surrounding water which is sucked in through the annular gap 49, from the top end of the bottom drill-string part 7 and circulates around the roller arrangement 24 and the angle profiles 22, with the result that any fractions of sediment which may have penetrated are always washed out.

What is claimed is:

1. Apparatus for sinking bore holes, in the sea bed, having a drill string which is suitable for transmitting a torque and of which the top end is mounted on a floating platform and of which the bottom end bears a rotationally driveable drill head and which comprises a plurality of drill-string parts which can be displaced with low friction in the axial direction of the drill string relative to one another, characterized in that there is provided an air inlet which is in connection with the drill-string interior and through which it is possible to blow in compressed air fed via a pressure line;

characterized in that the drill string comprises an outer and an inner drill-string part, wherein the inner drill-string part engages in the outer drill-string part, and wherein the outer drill-string part comprises an inner tube and an outer tube defining an annular gap between an internal diameter of the outer tube and an external diameter of the inner tube.

2. Apparatus according to claim 1, characterized in that the drill string comprises an outer and an inner drill-string part, it being the case that the inner drill-string part engages in the outer drill-string part, at least over a length which corresponds to the maximum upward vertical movements of the platform which are to be expected as a result of sea swell, and can be displaced further into the outer drill-string part, at least by an amount which corresponds to the maximum expected downward deflection of the platform out of its normal position.

3. Apparatus according to claim 2, characterized in that the inner drill-string part comprises, at least over the maximum length by which it projects into the outer drill-string part, rails, which are distributed over its outer circumference and on which there run sliding elements, which are distributed correspondingly over the inner circumference of the outer drill-string part.

4. Apparatus according to claim 2, characterized in that the inner drill-string part is mounted on the platform by way of its top end, and the outer drill-string part bears the drill head at its bottom end.

5. Apparatus according to claim 2, characterized in that arranged on the platform is a powered rotary head for making the drill string rotate about its longitudinal axis, and the drill head is arranged in a rotationally fixed manner on the drill string.

6. Apparatus according to claim 2, characterized in that the drill string is mounted in a rotationally fixed manner on the platform and there is provided a rotary drive, with the aid of which the drill head can be made to rotate with respect to the drill string.

7. Apparatus according to claim 6, characterized in that the rotary drive is operated electrically.

8. Apparatus according to claim 6, characterized in that the rotary drive is operated hydraulically.

9. Apparatus according to claim 1, characterized in that the pressure line for blowing the compressed air into the interior of the drill string is secured on the outer circumference of the drill string and runs parallel to the longitudinal center axis thereof.

10. Apparatus according to claim 1, characterized in that the pressure line provided is a pressure hose which can be unrolled from a winding drum.

11. Apparatus according to claim 1, characterized in that at least one buoyancy element is provided on the drill-string part of which the top end is mounted on the platform.

12. Apparatus for sinking bore holes, in the sea bed, having a drill string which is suitable for transmitting a torque and of which the top end is mounted on a floating platform and of which the bottom end bears a rotationally driveable drill head and which comprises a plurality of drill-string parts which can be displaced with low friction in the axial direction of the drill string relative to one another, characterized in that there is provided an air inlet which is in connection with the drill-string interior and through which it is possible to blow in compressed air fed via a pressure line;

characterized in that the drill string comprises an outer and an inner drill-string part, it being the case that the inner drill-string part engages in the outer drill-string part, at least over a length which corresponds to the maximum upward vertical movements of the platform which are to be expected as a result of sea swell, and can be displaced further into the outer drill-string part, at least by an amount which corresponds to the maximum expected downward deflection of the platform out of its normal position;

characterized in that the inner drill-string part comprises, at least over the maximum length by which it projects into the outer drill-string part, rails, which are distributed over its outer circumference and on which there run sliding elements, which are distributed correspondingly over the inner circumference of the outer drill-string part;

characterized in that the inner drill-string part is of tubular design and the rails comprise angle profiles which run in the direction of the longitudinal axis (L) of the inner drill-string part and are welded on the outer surface of the inner drill-string part by way of their free longitudinal edges.

13. Apparatus according to claim 12, characterized in that the outer drill-string part comprises, in the longitudinal direction of the same, at least one running-roller pair, which is arranged such that the two rollers of the running-roller pair are each assigned to an outer surface of a corresponding one of the angle profiles and are supported with rolling action on the same.

14. Apparatus according to claim 13, characterized in that each of the angle profiles comprises two legs which are at right angles with respect to one another, and each angle profile is assigned at least two longitudinally spaced-apart roller pairs each running on one leg outer surface.

15. Apparatus according to claim 14, characterized in that the outer drill-string part is of tubular design and comprises roller holders which are fastened on its outer circumference and each receive at least one roller, such that the axis thereof is located outside the cross section of the outer drill-string part and the running surface thereof projects, through a cutout made in the outer drill-string part, into the inner cross section of the outer drill-string part.

16. Apparatus for sinking bore holes, in the sea bed, having a drill string which is suitable for transmitting a torque and of which the top end is mounted on a floating platform and of which the bottom end bears a rotationally driveable drill head and which comprises a plurality of drill-sting parts which can be displaced with low friction in the axial direction of the drill string relative to one another, characterized in that there is provided an air inlet which is in connection with the drill-string interior and through which it is possible to blow in compressed air fed via a pressure line;

characterized in that the drill string comprises an outer and an inner drill-string part, it being the case that the inner drill-string part engages in the outer drill-string part, at least over a length which corresponds to the maximum upward vertical movements of the platform which are to be expected as a result of sea swell, and can be displaced further into the outer drill-string part, at least by an amount which corresponds to the maximum expected downward deflection of the platform out of its normal position; and characterized in that the drill string is mounted in a rotationally fixed manner on the platform and there is provided a rotary drive, with the aid of which the drill head can be made to rotate with respect to the drill string;

further comprising a gimbal for mounting the drill string on the platform.

17. Apparatus for sinking bore holes, in the sea bed, having a drill string which is suitable for transmitting a torque and of which the top end is mounted on a floating platform and of which the bottom end bears a rotationally driveable drill head and which comprises a plurality of drill-string parts which can be displaced with low friction in the axial direction of the drill string relative to one another, characterized in that there is provided an air inlet which is in connection with the drill-string interior and through which it is possible to blow in compressed air fed via a pressure line, characterized in that a buoyancy unit is arranged on the drill-string part which bears the drill head.

18. Apparatus according to claim 17, characterized in that the buoyancy unit is arranged in the vicinity of the top end of a bottom drill-string part.

19. Apparatus according to claim 17, characterized in that the buoyancy unit comprises at least one tank which may be filled with compressed air.

20. A method of sinking bore holes in the sea bed, the method comprising:

mounting a top end of a drill string to a floating platform;

arranging a rotating drill head at a bottom end of the drill string;

assembling the drill string comprising at least two telescopically interengaging drill string parts which, during a vertical movement of the floating platform, execute a movement relative to one another with the result that the drill head rests with an essentially constant force on a surface of the sea bed which is to be cleared away wherein the at least two telescopically interengaging drill-string parts comprise an outer and an inner drill-string part, wherein the outer drill-string part comprises an inner tube and an outer tube defining an annular gap between an internal diameter of the outer tube and an external diameter of the inner tube;

loosening material from the sea bed with the drill head; and delivering out of the bore hole, through an interior of the drill string, by using an air-lift method, the material that has been loosened from the sea bed.

21. The method of claim 20, wherein the arranging step includes arranging the drill head in a rotationally fixed manner on the drill string; and wherein the loosening step includes rotating the drill string, thus producing rotation of the drill head.

22. The method of claim 20, wherein the mounting step includes mounting the drill string in a rotationally fixed manner to the platform; and wherein the loosening step includes rotating the drill head relative to the drill string.

* * * * *